US005477781A

United States Patent [19]

Stefani

[11] Patent Number: 5,477,781

[45] Date of Patent: Dec. 26, 1995

[54] ROTARY GLAZING MACHINE HAVING AN ELASTICALLY DEFORMABLE MATRIX CYLINDER

[75] Inventor: Franco Stefani, Sassuolo, Italy

[73] Assignee: Syfal S.r.l., Sassuolo, Italy

[21] Appl. No.: 331,899

[22] Filed: Oct. 31, 1994

[30] Foreign Application Priority Data

Mar. 29, 1994 [IT] Italy ..... MO94A0044

[51] Int. Cl.[6] ..... B41F 9/00; B41N 1/12

[52] U.S. Cl. ..... 101/153; 101/36; 101/37; 101/157; 101/170; 101/376; 101/493; 118/212; 118/413

[58] Field of Search ..... 101/36, 37, 150, 101/153, 155, 157, 158, 167, 169, 170, 376, 401, 493; 118/212, 264, 413, DIG. 15

[56] References Cited

U.S. PATENT DOCUMENTS

| | | | |
|---|---|---|---|
| 2,926,628 | 3/1960 | Black et al. | 118/244 |
| 3,045,592 | 7/1962 | Shearer et al. | 118/212 |
| 3,368,482 | 2/1968 | Lusher et al. | 101/153 |
| 3,730,087 | 5/1973 | Trant et al. | 101/170 |
| 3,964,386 | 6/1976 | Dini | 101/170 |
| 4,294,187 | 10/1981 | Fogle | 118/244 |
| 4,479,432 | 10/1984 | Masaki et al. | 101/170 |
| 4,566,384 | 1/1986 | Matsumoto | 101/170 |
| 5,206,992 | 5/1993 | Carlson et al. | 101/376 |

FOREIGN PATENT DOCUMENTS

| | | | |
|---|---|---|---|
| 392742 | 8/1989 | Austria . | |
| 645223 | 3/1995 | European Pat. Off. . | |
| 9104907 | 4/1991 | Germany . | |
| 107340 | 6/1983 | Japan | 101/153 |
| 179347 | 10/1984 | Japan | 101/153 |
| 137768 | 6/1986 | Japan | 101/153 |
| 18267 | 1/1987 | Japan | 101/170 |
| 9201144 | 6/1992 | Netherlands . | |
| 1821377 | 10/1990 | U.S.S.R. . | |
| 1463284 | 4/1975 | United Kingdom . | |
| 2207092 | 6/1987 | United Kingdom . | |

*Primary Examiner*—Stephen Funk
*Attorney, Agent, or Firm*—Browdy and Neimark

[57] ABSTRACT

The invention comprises a mobile rest plane for tiles on which operates a matrix cylinder provided with an elastically deformable peripheral part having a smooth external skin made of an elastomer material, on which a matrix, in the form of microscopic cavities, is cut. A doctor, arranged in order to be in contact with the skin, has the task of scraping away excess glaze and any impurities deposited on the skin as well as the task of remixing the glaze such as at least partially to replenish the cavities with freshened glaze. The matrix cylinder is positioned on the rest plane such as to roll thereon without dragging on a tile upper surface as the tile transits on the rest plane.

10 Claims, 2 Drawing Sheets

ROTARY GLAZING MACHINE HAVING AN ELASTICALLY DEFORMABLE MATRIX CYLINDER

BACKGROUND OF THE INVENTION

The invention relates to a rotary machine for glazing and decorating ceramic tiles, and a process therefor.

At present either the silk-screening method or the flexographic method are used for decoratively glazing ceramic tiles.

The silk-screening method, using either a flat or a rotary cylindrical screen, presents numerous drawbacks. For example, half-tones are difficult to obtain, and due to the structure of the screens, whether flat or cylindrical, it is not possible to print the decoration on the edges of the tiles, where the upper surface meets the side surfaces. This latter defect is particularly evident in the prior art, where good reproduction of a decorative pattern can only be perfect away from the edges, where good contact with the tile is guaranteed.

A further drawback of the above method is the need to have an operative continually at the workplace, to control the machine efficiency and to clean the screens themselves.

Further drawbacks are the limited lifespan of the screens and the impossibility of having continuous printing screens.

The flexographic method also suffers from some of the above drawbacks, as well as presenting some inconveniences of its own: for example, it is impossible to print using only very small quantities of glaze, and too frequently the printing process actually leads to tile breakage, especially of still-unfired tiles.

BRIEF SUMMARY OF THE INVENTION

The main aim of the present invention is to obviate the above-mentioned drawbacks in the prior art by providing a rotary machine for decoration and glazing ceramic tiles, which is both rapid and thus does not limit the speed of a production line, and which does not require the continual presence of an operative to check on the quality of the final decoration and to keep the printing surfaces clean and conserve them so that a screen can have a long production life.

The invention also decorates unfired and deformed tiles without giving rise to breakage thereof, while maintaining a high level of printing quality.

Further advantageous characteristics of the invention are: it can continuously print half-tones; and it prints the decoration right up to the edges of the tiles, where the top surface meets the side surfaces, without causing damage to the print screen.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

DESCRIPTION OF THE PREFERRED EMBODIMENTS

Figure 1:
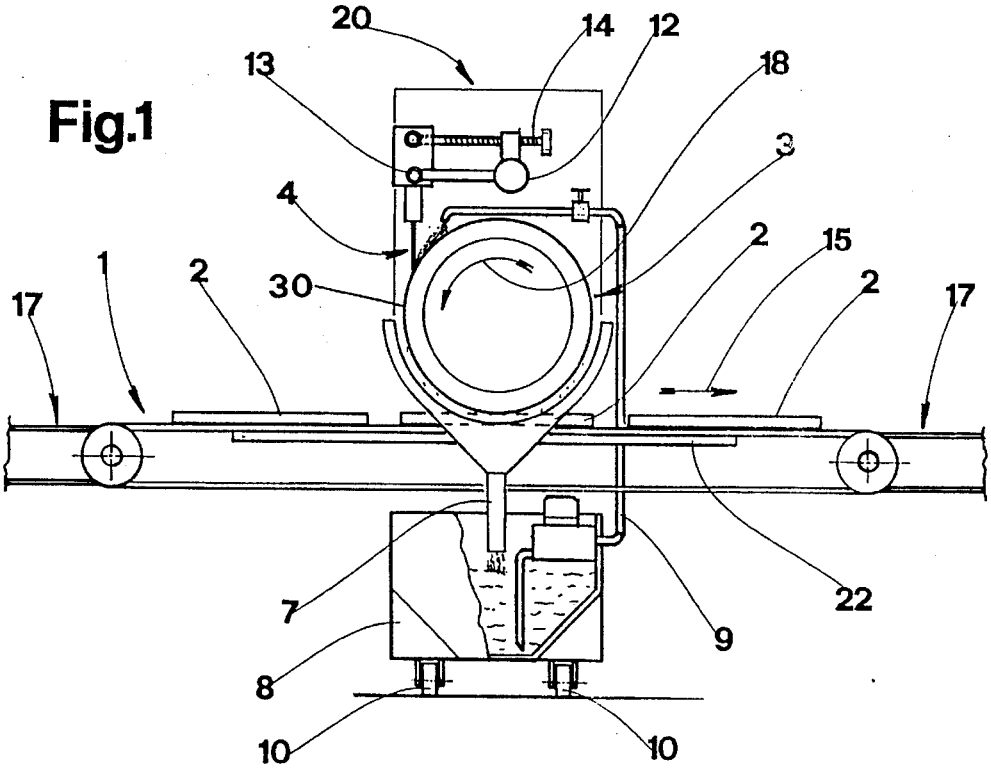
FIG. 1 is a schematic lateral vertical elevation.

With reference to the figures, 1 schematically denotes a mobile rest plane for ceramic tiles 2, whereon the tiles are conveyed in the sense and direction indicated by arrow 15.

The rest plane 1 can be a traditional conveyor belt supported inferiorly by a plane 22 along which the upper branch of the belt slides. The rest plane 1 is inserted into a usual tile transport line, for example of the belt type, which is denoted by 17 in the drawings.

A rotary decoration and glazing apparatus is positioned above the rest plane 1 and comprises a matrix cylinder 3 rotating about its own axis in the direction indicated by arrow 18, which matrix cylinder 3 comprises a center 34 externally bearing an elastically deformable peripheral layer which in turn is externally and peripherally covered by a smooth cylindrical skin 30. In particular the elastically deformable part comprises a soft and spongy inner layer 32 and an external layer 33, also elastically deformable but more compact than the inner layer 32.

The inner layer 32 is made of silicone foam, while the external layer 33 is made of silicone rubber, which in a preferred embodiment is polymerized by polyaddition.

At its ends the center 34 exhibits two crowns 35 and 36, having the same external diameter as the skin 30, to which they are coaxial. The whole matrix cylinder 3 is supported by a shaft which is not illustrated in the figures.

External constant-section annular channels 37 are provided on both crowns 35 and 36 and extend over all of the periphery thereof.

Below the downfacing side of the annular channels 37 of each of the crowns 35 and 36, glaze collecting baths 5 and 6 are situated, which are provided with glaze collection pipes 7 leading to a container 8 positioned below the apparatus and functioning also as a reservoir for the glaze, which is fed to the cylinder by means of a feed pipe 9.

The matrix, set on the smooth skin 30 of the matrix cylinder 3, comprises a plurality of microscopic cavities 31 all of which retain a small amount of glaze. The cavities 31 are uniformly distributed over all of the skin 30, and are characterized in that they exhibit a more or less constant breadth-depth ratio.

Arranged in contact with and along a generatrix of the matrix cylinder 3 is a doctor 4 supported on a frame 12 by means of a pivot 13.

Figure 2:
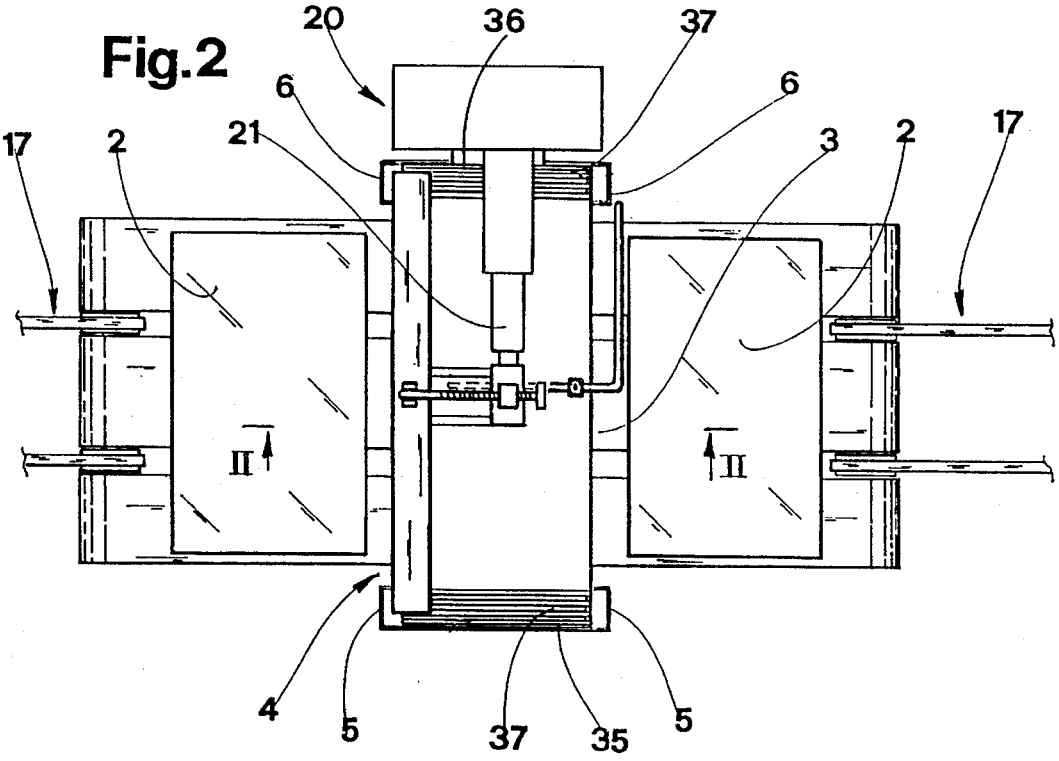
FIG. 2 is a schematic plan view from above of FIG. 1.
Figure 3:
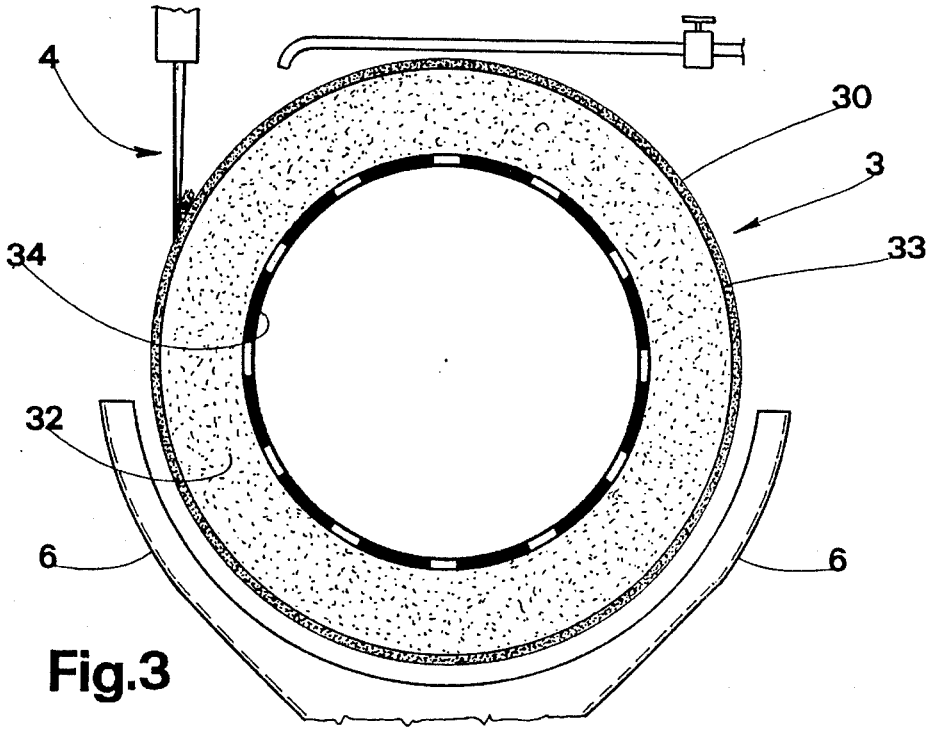
FIG. 3 shows in enlarged scale a part of a schematic section made according to line II—II of FIG. 2.

A screw device 14 acting between the doctor 4 and the frame 12 permits adjusting the pressure with which the blade of the doctor 4 presses against the skin 30 of the matrix cylinder 3. The doctor 4, as is clearly illustrated in figure 2, not only contacts the skin 30 but also the coaxial external cylindrical surfaces of the crowns 35 and 36. The doctor 4 oscillates alternatingly in a parallel direction to the matrix cylinder 3 axis, a movement which is transmitted to the frame 12 by a known-type device (not illustrated). The frame 12 is supported on a support arm 21 which is rotatable about a parallel axis to the matrix cylinder 3 axis. Thus the doctor 4 can be arranged at various inclinations with respect to the skin 30 of the matrix cylinder 3, such that the best configuration can be found for filling the cavities 31 and for cleaning the skin 30.

The doctor 4 has a further very important function of stirring, in effect, the glaze, by mixing it continuously, and also partially renews the glaze inside the cavities 31, especially when, during the course of a rotation, not all of the glaze already lodged in the cavities 31 is laid on the tiles. A still further function of the doctor 4 is to free the skin 30 from any impurities or extraneous bodies, by shifting such detritus to the edges thereof.

Figure 6:
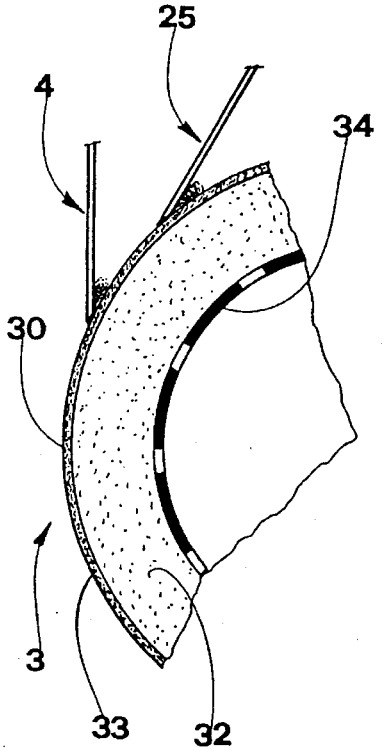
FIG. 6 is a detail of the schematic section of FIG. 3, referring to a further embodiment.
Figure 4:
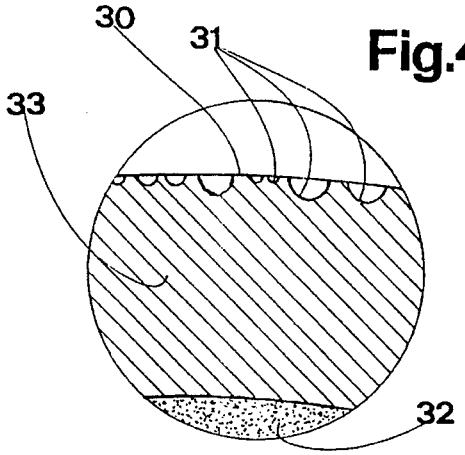
FIG. 4 shows, in enlarged scale, a detail of FIG. 3.
Figure 5:
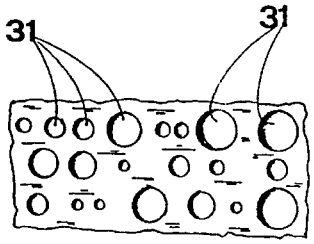
FIG. 5 is a schematic plan view from above of the detail of FIG. 4.

In a further embodiment, illustrated in FIG. 6, a second doctor 25 is provided upstream of the first doctor 4 and has the function of effecting a first scraping of the skin 30 such as to facilitate the subsequent reloading of the cavities 31.

The glaze is brought into the space comprised between the doctor 4 and the adjacent portion of the skin 30 through the feed pipe 9, which has its exit mouth situated in the appropriate zone.

The glaze is collected from the same container 8 into which the excess glaze is sent from the annular channels 37. The above-mentioned extraneous matter is also sent down with the glaze from the annular channels 37, and is deposited therewith in the baths 5 and 6, wherefrom the glaze flows down through the collection pipes 7 and into the container 8, located below the rest plane 1 and removable, being mounted on wheels 10 and resting on the floor.

The matrix cylinder 3 is set in rotation by a motor head 20 positioned by the side of the rest plane 1. The motor head 20 can move vertically to enable height-regulation of the matrix cylinder 3 with respect to the rest plane 1 conveying the tiles 2.

The motorization (not illustrated) producing the rotation of the matrix cylinder 3 is connected with the motorization producing the advancement of the tiles 2 on the rest plane 1 such that the skin 30 rotates without dragging and exerts a preestablished pressure on the upper surface of the tiles transiting on the rest plane 1.

When working at normal speed, the tiles 2, distanced correctly one from another, transit below the matrix cylinder 3, which is fed with glaze by the exit mouth of the feed pipe 9. The doctor 4 scrapes the skin 30, distributing the glaze and "freshening it" by continually remixing it, at least partially, inside the cavities 31. When contact occurs between the skin 30 and the surface of the tile 2, the glaze contained in the cavities 31 is extracted and deposited on said tile surface and reproduces, in plan, the distributions of the cavities 31 distributed on the skin 30 constituting the matrix.

Thanks to the elastic deformability of the external layer 33 and the inner layer 32, any eventual irregularity of the tile surface does not obstruct transfer of the glaze, which can therefore be laid even at the tile edges, where the upper surface meets the sides.

The arrangement of the glaze on the tile surface will perfectly reproduce the arrangement of the cavities 31 on the skin 30: obviously, the larger diameter cavities 31 will deposit larger quantities of glaze on the tile surface, while the smaller-diameter ones will deposit less, leading to excellent conditions for half-tone production. The decorating machine, thus, realizes a decoration and glazing process, in particular for ceramic tiles, which is characterized in that it comprises:

arrangement of glaze on a recess-formed matrix composed of a plurality of cavities 31 cut into a portion of cylindrical and elastically-deformable smooth skin 30;

removal by use of a doctor 4 of excess glaze deposited on the matrix cut into the skin 30; said doctor 4 also having the function of continually remixing the glaze and at least partially removing the glaze lodged in the cavities 31;

transfer of the glaze contained in the cavities 31 by direct contact, that is by rolling without dragging of the matrix set into the skin 30 on a transiting tile surface.

Apart from the possibility of continuously obtaining half-tones by depositing various batched quantities of glaze, deposited by cavities 31 of different dimensions, with the invention it is also possible, thanks to the elastic deformability of the peripheral part of the matrix cylinder 3, to perform decorations on unfired tiles without running the risk of breaking the tiles during the operation.

A further advantage of the present invention is that the device is self-cleaning: before coming into contact with the tile, the doctor 4 scrapes the cylinder 3 and thus at the same time cleans the skin 30 and fills the cavities 31. A still further advantage is the operative speed of the device, which does not in any way limit the pace of a tile production line.

What is claimed:

1. A machine for decoration and glazing ceramic tiles, comprising:

a mobile rest plane for ceramic tiles on which the tiles are conveyed in a preestablished direction;

a rotary decorating and glazing apparatus positioned above the rest plane and comprising:

a matrix cylinder rotatable about an axis of the cylinder and having at least one elastically deformable portion including at a periphery thereof a smooth cylindrical external surface skin made of an elastomer material on which a matrix is cut, said matrix being composed of a plurality of cavities;

at least a first doctor operating contactingly with the skin of the matrix cylinder such as to scrape thereagainst and remove therefrom an excess of glaze deposited thereon and adhering thereto;

means for rotating the matrix cylinder in a rotation sense about the axis thereof; and means for adjusting the matrix cylinder with respect to the rest plane such that the skin rotates without dragging against, and with a preestablished pressure upon, a surface of a tile transiting on the rest plane.

2. The machine as in claim 1, wherein the elastically deformable portion comprises a a spongy inner layer and an external layer which is more compact than the inner layer; the inner layer having a higher elastic deformability than the outer layer.

3. The machine as in claim 2, wherein the inner layer is made of silicone foam and the external layer is made of a silicone rubber.

4. The machine as in claim 1, wherein the plurality of cavities receive internally small quantities of glaze, and wherein the cavities exhibit a breadth-width ratio which is substantially constant.

5. The machine as in claim 1, including means for the first doctor to oscillate alternatingly parallel to the axis of the matrix cylinder and wherein the first doctor includes means to adjust the first doctor to various inclinations with respect to the skin of the matrix cylinder; whereby said first doctor combines a scraping and cleaning function with a glaze-remixing function which at each turn of the matrix cylinder at least partially replenishes the cavities with glaze.

6. The machine as in claim 1, comprising a second doctor located upstream of the first doctor according to the rotation sense of the matrix cylinder.

7. A machine for decoration and glazing ceramic tiles, comprising:

a mobile rest plane for ceramic tiles on which the tiles are conveyed in a preestablished direction;

a rotary decorating and glazing apparatus positioned above the rest plane and comprising:

a matrix cylinder rotatable about an axis of the cylinder and having at least one elastically deformable portion including at a periphery thereof a smooth cylindrical external surface skin made of an elastomer material on which a matrix is cut, said matrix being composed of a plurality of cavities;

at least a first doctor operating contactingly with the skin of the matrix cylinder such as to scrape thereagainst and remove therefrom an excess of glaze deposited thereon and adhering thereto;

means for rotating the matrix cylinder in a rotation sense about the axis thereof; and means for adjusting the matrix cylinder with respect to the rest plane such that the skin rotates without dragging against, and with a preestablished pressure upon, a surface of a tile transiting on the rest plane;

wherein the elastically deformable portion of the matrix cylinder is anchored on a cylindrical center which includes, solidly constrained to both ends thereof, two crowns having a same external diameter as the skin, the crowns and the skin being coaxial; each of the crowns including at least one external annular channel.

8. A machine as in claim 7, comprising, predisposed below a downfacing side of external annular channels of the crowns, collection baths of the glaze which are inferiorly provided with collection pipes leading to an underlying container, wherefrom a feed pipe removes the glaze and delivers it through an exit mouth to a zone immediately above a zone comprised between the first doctor and an adjacent portion of the skin.

9. A machine as in claim 8, wherein the container includes wheels and means for removing the container.

10. A rotary decoration and glazing process for ceramic tiles, comprising:

arranging glaze on a matrix composed of a plurality of cavities cut into a portion of a cylindrical and elastically-deformable smooth skin;

removing by use of at least a first doctor excess glaze deposited on the matrix cut into the skin; continually remixing the glaze and at least partially replenishing the glaze lodged in the cavities with said first doctor;

transferring the glaze contained in the cavities by direct contact, the contact including rolling without dragging, of the matrix against a transiting tile upper surface.

* * * * *